US008287611B2

(12) United States Patent
You et al.

(10) Patent No.: US 8,287,611 B2
(45) Date of Patent: Oct. 16, 2012

(54) ABRASIVE ARTICLES AND METHODS FOR MAKING SAME

(75) Inventors: Xiaorong You, Shrewsbury, MA (US); Anthony C. Gaeta, Lockport, NY (US); William C. Rice, Medway, MA (US)

(73) Assignee: Saint-Gobain Abrasives, Inc., Worcester, MA (US)

( * ) Notice: Subject to any disclaimer, the term of this patent is extended or adjusted under 35 U.S.C. 154(b) by 0 days.

(21) Appl. No.: 11/342,242

(22) Filed: Jan. 27, 2006

(65) Prior Publication Data

US 2006/0194038 A1 Aug. 31, 2006

Related U.S. Application Data

(60) Provisional application No. 60/648,168, filed on Jan. 28, 2005, provisional application No. 60/671,128, filed on Apr. 14, 2005.

(51) Int. Cl.
*B24D 3/28* (2006.01)
*B24D 3/34* (2006.01)

(52) U.S. Cl. ..... 51/295; 51/293; 51/298; 51/307; 51/308

(58) Field of Classification Search ..... 51/293, 51/298, 295, 307–309
See application file for complete search history.

(56) References Cited

U.S. PATENT DOCUMENTS

| | | | |
|---|---|---|---|
| 2,292,261 | A | 8/1942 | Albertson |
| 2,976,256 | A | 3/1961 | Whittier et al. |
| 3,708,296 | A | 1/1973 | Schlesinger |
| 4,250,053 | A | 2/1981 | Smith |
| 4,256,828 | A | 3/1981 | Smith |
| 4,457,766 | A | 7/1984 | Caul et al. |
| 4,751,102 | A | 6/1988 | Adair et al. |
| 4,772,530 | A | 9/1988 | Gottschalk et al. |
| 4,772,541 | A | 9/1988 | Gottschalk et al. |
| 4,853,434 | A | 8/1989 | Block |
| 4,903,440 | A | 2/1990 | Larson et al. |
| 5,002,856 | A | 3/1991 | Anderson |
| 5,059,701 | A | 10/1991 | Keipert |
| 5,108,463 | A | 4/1992 | Buchanan |
| 5,126,394 | A | 6/1992 | Revis et al. |
| 5,129,919 | A | 7/1992 | Kalinowski et al. |
| 5,137,542 | A | 8/1992 | Buchanan et al. |

(Continued)

FOREIGN PATENT DOCUMENTS

EP 0 035 969 A1 9/1981

(Continued)

OTHER PUBLICATIONS

"Standard Test Method for Viscosity by Ford Viscosity Cup"; Copyright by ASTM International; United States; pp. 1-4.

(Continued)

*Primary Examiner* — Roy King
*Assistant Examiner* — Jared Wood
(74) *Attorney, Agent, or Firm* — Abel Law Group, LLP; Joseph P. Sullivan

(57) ABSTRACT

The disclosure is directed to a radiation curable composition including abrasive grains and a binder composition. The binder composition includes about 10 wt % to about 90 wt % cationically polymerizable compound, not greater than about 40 wt % radically polymerizable compound, and about 5 wt % to about 80 wt % particulate filler based on the weight of the binder composition. The particulate filler includes dispersed submicron particulates.

10 Claims, 2 Drawing Sheets

U.S. PATENT DOCUMENTS

| | | | | |
|---|---|---|---|---|
| 5,191,101 | A | 3/1993 | Palazzotto et al. | |
| 5,252,694 | A | 10/1993 | Willett et al. | |
| 5,328,716 | A | 7/1994 | Buchanan | |
| 5,342,419 | A | 8/1994 | Hibbard | |
| 5,417,726 | A | 5/1995 | Stout et al. | |
| 5,451,446 | A | 9/1995 | Kincaid et al. | |
| 5,505,747 | A | 4/1996 | Chesley et al. | |
| 5,549,719 | A | 8/1996 | Lee et al. | |
| 5,556,437 | A | 9/1996 | Lee et al. | |
| 5,560,753 | A | 10/1996 | Schnabel et al. | |
| 5,565,011 | A | 10/1996 | Follett et al. | |
| 5,573,619 | A | 11/1996 | Benedict et al. | |
| 5,573,816 | A | 11/1996 | Gaeta et al. | |
| 5,700,302 | A | 12/1997 | Stoetzel et al. | |
| RE35,709 | E * | 1/1998 | Culler | 51/308 |
| 5,833,724 | A | 11/1998 | Wei et al. | |
| 5,863,306 | A | 1/1999 | Wei et al. | |
| 5,868,806 | A | 2/1999 | Nishio et al. | |
| 6,120,878 | A | 9/2000 | Follensbee et al. | |
| 6,165,061 | A | 12/2000 | Fuji et al. | |
| 6,258,138 | B1 | 7/2001 | DeVoe et al. | |
| 6,293,980 | B2 | 9/2001 | Wei et al. | |
| 6,398,826 | B1 | 6/2002 | Fuji et al. | |
| 6,410,127 | B1 | 6/2002 | Kamae et al. | |
| 6,432,549 | B1 | 8/2002 | Kronzer | |
| 6,467,897 | B1 | 10/2002 | Wu et al. | |
| 6,521,004 | B1 | 2/2003 | Culler et al. | |
| 6,605,128 | B2 | 8/2003 | Larson et al. | |
| 6,613,113 | B2 | 9/2003 | Minick et al. | |
| 6,657,001 | B1 | 12/2003 | Anderson et al. | |
| 6,660,828 | B2 | 12/2003 | Thomas et al. | |
| 6,669,745 | B2 | 12/2003 | Prichard et al. | |
| 6,758,734 | B2 | 7/2004 | Braunschweig et al. | |
| 6,773,474 | B2 | 8/2004 | Koehnle et al. | |
| 6,797,023 | B2 | 9/2004 | Knapp et al. | |
| 6,905,772 | B2 | 6/2005 | Shoup et al. | |
| 6,929,539 | B2 | 8/2005 | Schutz et al. | |
| 7,022,801 | B2 | 4/2006 | Medsker | |
| 7,087,710 | B2 | 8/2006 | Medsker et al. | |
| 7,497,885 | B2 | 3/2009 | Kollodge et al. | |
| 7,591,865 | B2 | 9/2009 | Gaeta et al. | |
| 2002/0037683 | A1* | 3/2002 | Goers et al. | 451/41 |
| 2002/0170236 | A1 | 11/2002 | Larson et al. | |
| 2003/0049995 | A1 | 3/2003 | Schultz et al. | |
| 2003/0109662 | A1 | 6/2003 | Medsker et al. | |
| 2003/0131937 | A1* | 7/2003 | Konarski | 156/330 |
| 2003/0143938 | A1 | 7/2003 | Braunschweig et al. | |
| 2003/0176156 | A1 | 9/2003 | Braunschweig et al. | |
| 2003/0200701 | A1 | 10/2003 | Koehnle et al. | |
| 2004/0020133 | A1 | 2/2004 | Paxton et al. | |
| 2004/0029511 | A1* | 2/2004 | Kincaid et al. | 451/526 |
| 2004/0048957 | A1 | 3/2004 | Medsker et al. | |
| 2004/0147029 | A1 | 7/2004 | Adam | |
| 2004/0152799 | A1 | 8/2004 | Miller et al. | |
| 2004/0242804 | A1 | 12/2004 | Medsker et al. | |
| 2005/0019574 | A1 | 1/2005 | McCrary | |
| 2005/0020190 | A1 | 1/2005 | Schutz et al. | |
| 2005/0025967 | A1 | 2/2005 | Lawton et al. | |
| 2005/0032469 | A1 | 2/2005 | Duescher | |
| 2005/0069714 | A1 | 3/2005 | Hart et al. | |
| 2005/0223649 | A1 | 10/2005 | O'Gary et al. | |
| 2005/0262773 | A1 | 12/2005 | Schutz et al. | |
| 2006/0148642 | A1 | 7/2006 | Ryu et al. | |
| 2006/0154082 | A1 | 7/2006 | Miller et al. | |
| 2006/0211563 | A1 | 9/2006 | Arbab et al. | |
| 2006/0234901 | A1 | 10/2006 | Scheuing et al. | |
| 2008/0306203 | A1* | 12/2008 | Adam et al. | 524/493 |

FOREIGN PATENT DOCUMENTS

| | | | |
|---|---|---|---|
| EP | 0 044 274 | A2 | 1/1982 |
| EP | 0 054 509 | A2 | 6/1982 |
| EP | 0 094 914 | A2 | 11/1983 |
| EP | 0 094 915 | A2 | 11/1983 |
| EP | 0 153 904 | A2 | 9/1985 |
| EP | 0 164 314 | A2 | 12/1985 |
| EP | 0 223 587 | A1 | 5/1987 |
| EP | 0 266 513 | A2 | 5/1988 |
| EP | 0 407 834 | A2 | 1/1991 |
| EP | 0546831 | B1 | 6/1993 |
| EP | 1 236 765 | A1 | 9/2002 |
| EP | 1312655 | A2 | 5/2003 |
| EP | 1 342 742 | A1 | 9/2003 |
| EP | 1 366 112 | B1 | 7/2004 |
| EP | 1 457 509 | A1 | 9/2004 |
| EP | 1 463 775 | | 10/2004 |
| EP | 1487612 | B1 | 4/2006 |
| JP | 6-206167 | | 7/1994 |
| JP | 9-503811 | | 4/1997 |
| JP | 9-506557 | | 6/1997 |
| JP | 2000-507885 | | 6/2000 |
| JP | 2001-521831 | | 11/2001 |
| WO | 95/11111 | | 4/1995 |
| WO | 95/16547 | | 6/1995 |
| WO | WO 96/09141 | | 3/1996 |
| WO | 98/30358 | | 7/1998 |
| WO | WO 98/28663 | | 7/1998 |
| WO | WO 98/51747 | | 11/1998 |
| WO | 99/22912 | | 5/1999 |
| WO | 0037569 | A1 | 6/2000 |
| WO | 0109260 | A1 | 2/2001 |
| WO | 0234848 | A1 | 5/2002 |
| WO | WO 02/083776 | * | 10/2002 |
| WO | WO 02/083776 | A1 | 10/2002 |
| WO | 02092660 | A2 | 11/2002 |
| WO | WO 03/055948 | A1 | 7/2003 |
| WO | 2004013231 | A2 | 2/2004 |
| WO | 2004067599 | A1 | 8/2004 |
| WO | WO 2004/081076 | A1 | 9/2004 |
| WO | 2005005506 | A1 | 1/2005 |
| WO | 2005026229 | A1 | 3/2005 |
| WO | 2005035200 | A | 4/2005 |
| WO | 2005047358 | A1 | 5/2005 |
| WO | 2006043072 | A1 | 4/2006 |
| WO | 2006065411 | A1 | 6/2006 |
| WO | 2006069179 | A2 | 6/2006 |
| WO | 2006083688 | A1 | 8/2006 |

OTHER PUBLICATIONS

"Standard Test Method for Kinematic Viscosity of Transparent and Opaques Liquids (and the Calculation of Dynamic Viscosity)"; Copyright by ASTM International; United States; pp. 1-10.

Stephan Sprenger, et al.; "Nano-modified Ambient Temperature Curing Epoxy Adhesives"; Special Issue of adhesion Kleben & Dichten; Mar. 2004; 5 pgs.

"Excellent Impregnation and Reduced Shrinkage"; hanse-chemie.com; pp. 1-3.

U.S. Appl. No. 11/342,329, filed Jan. 27, 2006, Gaeta, et al.

"CAB-O-SIL® Untreated Fumed Silica Properties & Functions," Brochure, 10 pages.

Jim Husman; Nanomaterials at 3M, Coupling Nanotechnology to Business Opportunities' PennState Materials Day: Commercial Applications of Nanotechnology, Apr. 15, 2004, 30 pages.

* cited by examiner

ABRASIVE ARTICLES AND METHODS FOR MAKING SAME

CORRESPONDING APPLICATIONS

The present application claims priority from U.S. Provisional Patent Application No. 60/648,168, filed Jan. 28, 2005, entitled "ABRASIVE ARTICLES AND METHODS FOR MAKING SAME," naming applicants Xiaorong You, Anthony C. Gaeta, and William C. Rice, which application is incorporated by reference herein in its entirety.

The present application claims priority from U.S. Provisional Patent Application No. 60/671,128, filed Apr. 14, 2005, entitled "METHODS OF FORMING STRUCTURED ABRASIVE ARTICLE," naming applicants Anthony C. Gaeta, Xiaorong You, and William C. Rice, which application is incorporated by reference herein in its entirety.

FIELD OF THE DISCLOSURE

This disclosure, in general, relates to abrasive articles and methods for making same.

BACKGROUND

Abrasive articles, such as coated abrasives and bonded abrasives, are used in various industries to machine workpieces, such as by lapping, grinding, or polishing. Machining utilizing abrasive articles spans a wide industrial scope from optics industries, automotive paint repair industries, to metal fabrication industries. In each of these examples, manufacturing facilities use abrasives to remove bulk material or affect surface characteristics of products.

Surface characteristics include shine, texture, and uniformity. For example, manufacturers of metal components use abrasive articles to fine and polish surfaces, and oftentimes desire a uniformly smooth surface. Similarly, optics manufacturers desire abrasive articles that produce defect free surfaces to prevent light diffraction and scattering.

Manufactures also desire abrasive articles that have a high stock removal rate for certain applications. However, there is often a trade-off between removal rate and surface quality. Finer grain abrasive articles typically produce smoother surfaces, yet have lower stock removal rates. Lower stock removal rates lead to slower production and increased cost.

Particularly in the context of fine grained abrasive articles, commercially available abrasives have a tendency to leave random surface defects, such as scratches that are deeper than the average stock removal scratches. Such scratches may be caused by grains that detach from the abrasive article, causing rolling indentations. When present, these scratches scatter light, reducing optical clarity in lenses or producing haze or a foggy finish in decorative metal works. Such scratches also provide nucleation points or attachment points that reduce the release characteristics of a surface. For example, scratches in sanitary equipment allow bacteria to attach to surfaces, and scratches in polished reactors allow formation of bubbles and act as surface features for initiating unwanted reactions.

Loss of grains also degrades the performance of abrasive articles, leading to frequent replacement. Frequent abrasive article replacement is costly to manufacturers. As such, improved abrasive articles and methods for manufacturing abrasive articles would be desirable.

SUMMARY

In one particular embodiment, a composition includes abrasive grains and a binder composition. The binder composition includes about 10 wt % to about 90 wt % cationically polymerizable compound, not greater than about 40 wt % radically polymerizable compound, and about 5 wt % to about 80 wt % particulate filler based on the weight of the binder composition. The particulate filler includes dispersed submicron particulates.

The disclosure is also directed to an exemplary abrasive article including abrasive grains and a binder comprising a cured formulation. The formulation includes not greater than about 90 wt % nanocomposite epoxy precursor and includes acrylic precursor.

In another exemplary embodiment, an abrasive article includes abrasive grains and a binder comprising a cured formulation. The formulation includes epoxy precursor and at least about 5 wt % particulate filler based on the total weight of the formulation. The particulate filler has a submicron average particle size.

In a further exemplary embodiment, an abrasive article includes abrasive grains and a colloidal composite binder.

In another exemplary embodiment, an abrasive article includes abrasive grains and a solution formed nanocomposite binder.

In a further exemplary embodiment, an abrasive article includes abrasive grains and composite binder. The composite binder includes disperse particulate filler having an average particle size of about 3 nm to about 200 nm and a particle size distribution characterized by a half-width not greater than about 2 times the average particle size.

In a further exemplary embodiment, an abrasive article includes a binder that has an Rz Performance not greater than about 3.0 and comprises epoxy/acrylate copolymer.

In another exemplary embodiment, a method of forming an abrasive article includes providing a colloidal composite binder formulation and abrasive grains on a backing and curing the colloidal composite binder formulation.

In a further exemplary embodiment, a method of forming an abrasive article includes coating a backing with abrasive grains and a make coat including a first binder formulation. The method further includes applying a size coat over the make coat. The size coat includes a second binder formulation including nanocomposite polymer formulation. The method also includes curing the make coat and the size coat.

In another exemplary embodiment, a method of forming an abrasive article includes blending a nanocomposite epoxy precursor and acrylic precursor to form a binder formulation, applying the binder formulation to a substrate, applying abrasive grains to the substrate, and curing the binder formulation.

BRIEF DESCRIPTION OF THE DRAWINGS

The present disclosure may be better understood, and its numerous features and advantages made apparent to those skilled in the art by referencing the accompanying drawings.

DESCRIPTION OF THE DRAWINGS

Figure 1:
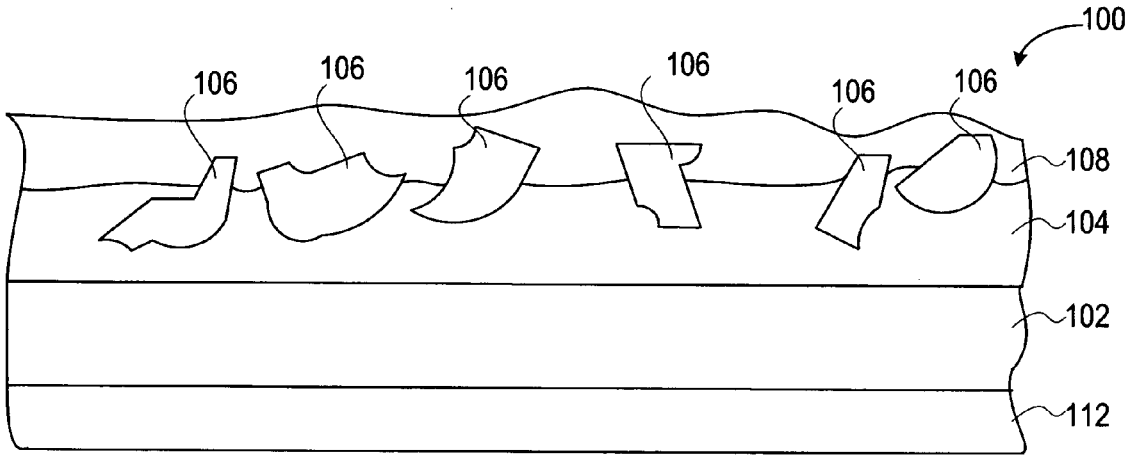
FIG. 1 includes an illustration of an exemplary coated abrasive article.

In a particular embodiment, an abrasive article includes abrasive grains and a colloidal composite binder. The abrasive article can be a coated abrasive article or a bonded abrasive article. In an embodiment, a coated abrasive article is an engineered or structured abrasive article, including patterned abrasive surface structures.

The colloidal composite binder generally includes a polymer matrix and particulate filler. The colloidal composite binder is formed from a binder formulation including a colloidally suspended particular filler within an external phase including polymeric components, such as monomers or polymers. The binder formulation may further include catalysts, polyermization initiators, chain transfer agents, reaction inhibitors, plasticizers and dispersants.

In another embodiment, the disclosure is directed to an abrasive article including a solution formed nanocomposite binder. Solution formed nanocomposite binders are formed from solution-formed nanocomposite formulations, which are formed in sol or sol-gel processes and include nano-sized particulate filler suspended in polymer constituent suspension. In a particular embodiment, the particulate filler has an average particle size about 3 nm to about 200 nm, such as between about 3 nm to about 100 nm, and a particle size distribution characterized by a half-width not greater than about twice the average particle size.

In particular embodiments, nanocomposite binders and colloidal composite binders have an Rz Performance, as described below, not greater than about 3.0. The binder may include polymeric constituents selected from the group consisting of epoxy constituents, acrylate constituents, oxetane constituents, and a combination thereof. Further, the polymeric constituents may be thermally curable or curable using actinic radiation.

The composite binders described herein generally include particulate filler dispersed in a polymer matrix. Prior to curing, the composite binder formulation is typically a suspension that includes an external phase including organic polymeric constituents and, optionally, solvents. A polymeric constituent may be a monomer or a polymer in solvent. For example, the external phase may include monomers that polymerize upon curing. Alternatively or in addition, the external phase may include polymer material in a solvent. The particulate filler generally forms a dispersed phase within the external phase.

The particulate filler may be formed of inorganic particles, such as particles of, for example, a metal (such as, for example, steel, silver, or gold) or a metal complex such as, for example, a metal oxide, a metal hydroxide, a metal sulfide, a metal halogen complex, a metal carbide, a metal phosphate, an inorganic salt (like, for example, $CaCO_3$), a ceramic, or a combinations thereof. An example of a metal oxide is ZnO, CdO, $SiO_2$, $TiO_2$, $ZrO_2$, $CeO_2$, $SnO_2$, $MoO_3$, $WO_3$, $Al_2O_3$, $In_2O_3$, $La_2O_3$, $Fe_2O_3$, CuO, $Ta_2O_5$, $Sb_2O_3$, $Sb_2O_5$, or a combination thereof. A mixed oxide containing different metals may also be present. The nanoparticles may include, for example, particles selected from the group consisting of ZnO, $SiO_2$, $TiO_2$, $ZrO_2$, $SnO_2$, $Al_2O_3$, co-formed silica alumina and a mixture thereof. The nanometer sized particles may also have an organic component, such as, for example, carbon black, a highly crosslinked/core shell polymer nanoparticle, an organically modified nanometer-size particle, etc. Such fillers are described in, for example, U.S. Pat. No. 6,467,897 and WO 98/51747, hereby incorporated by reference.

Particulate filler formed via solution-based processes, such as sol-formed and sol-gel formed ceramics, are particularly well suited for use in the composite binder. Suitable sols are commercially available. For example, colloidal silicas in aqueous solutions are commercially available under such trade designations as "LUDOX" (E.I. DuPont de Nemours and Co., Inc. Wilmington, Del.), "NYACOL" (Nyacol Co., Ashland, Ma.) and "NALCO" (Nalco Chemical Co., Oak Brook, Ill.). Many commercially available sols are basic, being stabilized by alkali, such as sodium hydroxide, potassium hydroxide, or ammonium hydroxide. Additional examples of suitable colloidal silicas are described in U.S. Pat. No. 5,126,394, incorporated herein by reference. Especially well-suited are sol-formed silica and sol-formed alumina. The sols can be functionalized by reacting one or more appropriate surface-treatment agents with the inorganic oxide substrate particles in the sol.

In a particular embodiment, the particulate filler is submicron sized. For example, the particulate filler may be a nano-sized particulate filler, such as a particulate filler having an average particle size of about 3 mm to about 500 nm. In an exemplary embodiment, the particulate filler has an average particle size about 3 nm to about 200 nm, such as about 3 nm to about 100 nm, about 3 nm to about 50 nm, about 8 nm to about 30 nm, or about 10 nm to about 25 nm. In particular embodiments, the average particle size is not greater than about 500 nm, such as not greater than about 200 nm, less than about 100 nm, or not greater than about 50 nm. For the particulate filler, the average particle size may be defined as the particle size corresponding to the peak volume fraction in a small-angle neutron scattering (SANS) distribution curve or the particle size corresponding to 0.5 cumulative volume fraction of the SANS distribution curve.

The particulate filler may also be characterized by a narrow distribution curve having a half-width not greater than about 2.0 times the average particle size. For example, the half-width may be not greater than about 1.5 or not greater than about 1.0. The half-width of the distribution is the width of the distribution curve at half its maximum height, such as half of the particle fraction at the distribution curve peak. In a particular embodiment, the particle size distribution curve is mono-modal. In an alternative embodiment, the particle size distribution is bi-modal or has more than one peak in the particle size distribution.

In a particular embodiment, the binder formulation may include at least two particulate fillers. Each of the particulate fillers may be formed of a material selected from the materials described above in relation to the particulate filler. The particulate fillers may be of the same material or of different materials. For example, each of the particulate fillers may be formed of silica. In an alternative example, one filler may be formed of silica and another filler may be formed of alumina. In an example, each of the particulate fillers has a particle size distribution having an average particle size not greater than about 1000 nm, such as not greater than about 500 nm or less than about 100 nm. In another example, one of the particulate fillers has a particle size distribution having an average particle size not greater than about 1000 nm, such as not greater than about 500 nm or less than about 100 nm, while a second particulate filler has an average particle size greater than about 1 micron, such as about 1 micron to about 10 microns or about 1 micron to about 5 microns. Alternatively, the second particulate filler may have an average particle size as high as 1500 microns. In a particular embodiment, a binder formulation including a first particulate filler having a submicron average particle size and a second particulate filler having an average particle size greater than 1 micron advantageously provides improved mechanical properties when cured to form a binder.

Typically, the second particulate filler has a low aspect ratio. For example, the second particulate filler may have an aspect ratio not greater than about 2, such as about 1 or nearly spherical. Generally, the second particulate filler is untreated and not hardened through treatments. In contrast, abrasive grains typically are hardened particulates with an aspect ratio at least about 2 and sharp edges.

When selecting a second particulate filler, settling speed and viscosity are generally considered. As size increases, particulate fillers having a size greater than 1 micron tend to settle faster, yet exhibit less viscosity at higher loading. In addition, refractive index of the particulate filler may be considered. For example, a particulate filler may be selected with a refractive index at least about 1.35. Further, a particulate filler may be selected that does not include basic residue as basic residue may adversely influence polymerization of cationically polymerizing constituents.

The particulate filler is generally dispersed in an external phase. Prior to curing, the particulate filler is colloidally dispersed within the binder suspension and forms a colloidal composite binder once cured. For example, the particulate material may be dispersed such that Brownian motion sustains the particulate filler in suspension. In general, the particulate filler is substantially free of particulate agglomerates. For example, the particulate filler may be substantially monodisperse such that the particulate filler is dispersed as single particles, and, in particular examples, has only insignificant particulate agglomeration, if any.

In a particular embodiment, the particles of the particulate filler are substantially spherical. Alternatively, the particles may have a primary aspect ratio greater than 1, such as at least about 2, at least about 3, or at least about 6, wherein the primary aspect ratio is the ratio of the longest dimension to the smallest dimension orthogonal to the longest dimension. The particles may also be characterized by a secondary aspect ratio defined as the ratio of orthogonal dimensions in a plane generally perpendicular to the longest dimension. The particles may be needle-shaped, such as having a primary aspect ratio at least about 2 and a secondary aspect ratio not greater than about 2, such as about 1. Alternatively, the particles may be platelet-shaped, such as having an aspect ratio at least about 2 and a secondary aspect ratio at least about 2.

In an exemplary embodiment, the particulate filler is prepared in an aqueous solution and mixed with the external phase of the suspension. The process for preparing such suspension includes introducing an aqueous solution, such as an aqueous silica solution; polycondensing the silicate, such as to a particle size of 3 nm to 50 nm; adjusting the resulting silica sol to an alkaline pH; optionally concentrating the sol; mixing the sol with constituents of the external fluid phase of the suspension; and optionally removing water or other solvent constituents from the suspension. For example, an aqueous silicate solution is introduced, such as an alkali metal silicate solution (e.g., a sodium silicate or potassium silicate solution) with a concentration in the range between 20% and 50% by weight based on the weight of the solution. The silicate is polycondensed to a particle size of 3 nm to 50 μm, for example, by treating the alkali metal silicate solution with acidic ion exchangers. The resulting silica sol is adjusted to an alkaline pH (e.g., pH>8) to stabilize against further polycondensation or agglomeration of existing particles. Optionally, the sol can be concentrated, for example, by distillation, typically to $SiO_2$ concentration of about 30 to 40% by weight. The sol is mixed with constituents of the external fluid phase. Thereafter, water or other solvent constituents are removed from the suspension. In a particular embodiment, the suspension is substantially water-free.

The fraction of the external phase in the pre-cured binder formulation, generally including the organic polymeric constituents, as a proportion of the binder formulation can be about 20% to about 95% by weight, for example, about 30% to about 95% by weight, and typically from about 50% to about 95% by weight, and even more typically from about 55% to about 80% by weight. The fraction of the dispersed particulate filler phase can be about 5% to about 80% by weight, for example, about 5% to about 70% by weight, typically from about 5% to about 50% by weight, and more typically from about 20% to about 45% by weight. The colloidally dispersed and submicron particulate fillers described above are particularly useful in concentrations at least about 5 wt %, such as at least about 10 wt %, at least about 15 wt %, at least about 20 wt %, or as great as 40 wt % or higher. In contrast with traditional fillers, the solution formed nanocomposites exhibit low viscosity and improved processing characteristics at higher loading. The amounts of components are expressed as weight % of the component relative to the total weight of the composite binder formulation, unless explicitly stated otherwise.

The external phase may include one or more reaction constituents or polymer constituents for the preparation of a polymer. A polymer constituent may include monomeric molecules, polymeric molecules or a combination thereof. The external phase may further comprise components selected from the group consisting of solvents, plasticizers, chain transfer agents, catalysts, stabilizers, dispersants, curing agents, reaction mediators and agents for influencing the fluidity of the dispersion.

The polymer constituents can form thermoplastics or thermosets. By way of example, the polymer constituents may include monomers and resins for the formation of polyurethane, polyurea, polymerized epoxy, polyester, polyimide, polysiloxanes (silicones), polymerized alkyd, styrene-butadiene rubber, acrylonitrile-butadiene rubber, polybutadiene, or, in general, reactive resins for the production of thermoset polymers. Another example includes an acrylate or a methacrylate polymer constituent. The precursor polymer constituents are typically curable organic material (i.e., a polymer monomer or material capable of polymerizing or crosslinking upon exposure to heat or other sources of energy, such as electron beam, ultraviolet light, visible light, etc., or with time upon the addition of a chemical catalyst, moisture, or other agent which cause the polymer to cure or polymerize). A precursor polymer constituent example includes a reactive constituent for the formation of an amino polymer or an aminoplast polymer, such as alkylated urea-formaldehyde polymer, melamine-formaldehyde polymer, and alkylated benzoguanamine-formaldehyde polymer; acrylate polymer including acrylate and methacrylate polymer, alkyl acrylate, acrylated epoxy, acrylated urethane, acrylated polyester, acrylated polyether, vinyl ether, acrylated oil, or acrylated silicone; alkyd polymer such as urethane alkyd polymer; polyester polymer; reactive urethane polymer; phenolic polymer such as resole and novolac polymer; phenolic/latex polymer; epoxy polymer such as bisphenol epoxy polymer; isocyanate; isocyanurate; polysiloxane polymer including alkylalkoxysilane polymer; or reactive vinyl polymer. The external phase of the binder formulation may include a monomer, an oligomer, a polymer, or a combination thereof. In a particular embodiment, the external phase of the binder formulation includes monomers of at least two types of polymers that when cured may crosslink. For example, the external phase may include epoxy constituents and acrylic constituents that when cured form an epoxy/acrylic polymer.

In an exemplary embodiment, the polymer reaction components include anionically and cationically polymerizable precursors. For example, the external phase may include at least one cationically curable component, e.g., at least one cyclic ether component, cyclic lactone component, cyclic acetal component, cyclic thioether component, spiro orthoester component, epoxy-functional component, or oxetane-functional component. Typically, the external phase includes at least one component selected from the group consisting of epoxy-functional components and oxetane-functional components. The external phase may include, relative to the total weight of the composite binder formulation, at least about 10 wt % of cationically curable components, for example, at least about 20 wt %, typically at least about 40 wt %, or at least about 50 wt %. Generally, the external phase includes, relative to the total weight of the composite binder formulation, not greater than about 95 wt % of cationically curable components, for example, not greater than about 90 wt %, not greater than about 80 wt %, or not greater than about 70 wt %.

The external phase may include at least one epoxy-functional component, e.g., an aromatic-epoxy-functional component ("aromatic epoxy") or an aliphatic epoxy-functional component ("aliphatic epoxy"). Epoxy-functional components are components comprising one or more epoxy groups, i.e., one or more three-member ring structures (oxiranes).

Aromatic epoxies components include one or more epoxy groups and one or more aromatic rings. The external phase may include one or more aromatic epoxy components. An example of an aromatic epoxy component includes an aromatic epoxy derived from a polyphenol, e.g., from bisphenols, such as bisphenol A (4,4'-isopropylidenediphenol), bisphenol F (bis[4-hydroxyphenyl]methane), bisphenol S (4,4'-sulfonyldiphenol), 4,4'-cyclohexylidenebisphenol, 4,4'-biphenol, or 4,4'-(9-fluorenylidene)diphenol. The bisphenol may be alkoxylated (e.g., ethoxylated or propoxylated) or halogenated (e.g., brominated). Examples of bisphenol epoxies include bisphenol diglycidyl ethers, such as diglycidyl ether of Bisphenol A or Bisphenol F.

A further example of an aromatic epoxy includes triphenylolmethane triglycidyl ether, 1,1,1-tris(p-hydroxyphenyl) ethane triglycidyl ether, or an aromatic epoxy derived from a monophenol, e.g., from resorcinol (for example, resorcin diglycidyl ether) or hydroquinone (for example, hydroquinone diglycidyl ether). Another example is nonylphenyl glycidyl ether.

In addition, an example of an aromatic epoxy includes epoxy novolac, for example, phenol epoxy novolac and cresol epoxy novolac. A commercial example of a cresol epoxy novolac includes, for example, EPICLON N-660, N-665, N-667, N-670, N-673, N-680, N-690, or N-695, manufactured by Dainippon Ink and Chemicals, Inc. An example of a phenol epoxy novolac includes, for example, EPICLON N-740, N-770, N-775, or N-865, manufactured by Dainippon Ink and Chemicals Inc.

In one embodiment, the external phase may contain, relative to the total weight of the composite binder formulation, at least 10 wt % of one or more aromatic epoxies.

Aliphatic epoxy components have one or more epoxy groups and are free of aromatic rings. The external phase may include one or more aliphatic epoxies. An example of an aliphatic epoxy includes glycidyl ether of C2-C30 alkyl; 1,2 epoxy of C3-C30 alkyl; mono or multi glycidyl ether of an aliphatic alcohol or polyol such as 1,4-butanediol, neopentyl glycol, cyclohexane dimethanol, dibromo neopentyl glycol, trimethylol propane, polytetramethylene oxide, polyethylene oxide, polypropylene oxide, glycerol, and alkoxylated aliphatic alcohols; or polyols.

In one embodiment, the aliphatic epoxy includes one or more cycloaliphatic ring structures. For example, the aliphatic epoxy may have one or more cyclohexene oxide structures, for example, two cyclohexene oxide structures. An example of an aliphatic epoxy comprising a ring structure includes hydrogenated bisphenol A diglycidyl ether, hydrogenated bisphenol F diglycidyl ether, hydrogenated bisphenol S diglycidyl ether, bis(4-hydroxycyclohexyl)methane diglycidyl ether, 2,2-bis(4-hydroxycyclohexyl)propane diglycidyl ether, 3,4-epoxycyclohexylmethyl-3,4-epoxycyclohexanecarboxylate, 3,4-epoxy-6-methylcyclohexylmethyl-3,4-epoxy-6-methylcyclohexanecarboxylate, di(3,4-epoxycyclohexylmethyl)hexanedioate, di(3,4-epoxy-6-methylcyclohexylmethyl)hexanedioate, ethylenebis(3,4-epoxycyclohexanecarboxylate), ethanedioldi(3,4-epoxycyclohexylmethyl)ether, or 2-(3,4-epoxycyclohexyl-5,5-spiro-3,4-epoxy)cyclohexane-1,3-dioxane. An example of an aliphatic epoxy is also listed in U.S. Pat. No. 6,410,127, which is hereby incorporated in its entirety by reference.

In an embodiment, the external phase includes, relative to the total weight of the composite binder formulation, at least about 5 wt % of one or more aliphatic epoxies, for example, at least about 10 wt % or at least about 20 wt % of the aliphatic epoxy. Generally, the external phase includes, relative to the total weight of the composite binder formulation, not greater than about 70 wt % of the aliphatic epoxy, for example, not greater than about 50 wt %, not greater than about 40 wt %.

Typically, the external phase includes one or more mono or poly glycidylethers of aliphatic alcohols, aliphatic polyols, polyesterpolyols or polyetherpolyols. An xample of such a component includes 1,4-butanedioldiglycidylether, glycidylether of polyoxyethylene or polyoxypropylene glycol or triol of molecular weight from about 200 to about 10,000; glycidylether of polytetramethylene glycol or poly(oxyethylene-oxybutylene) random or block copolymers. An example of commercially available glycidylether includes a polyfunctional glycidylether, such as Heloxy 48, Heloxy 67, Heloxy 68, Heloxy 107, and Grilonit F713; or monofunctional glycidylethers, such as Heloxy 71, Heloxy 505, Heloxy 7, Heloxy 8, and Heloxy 61 (sold by Resolution Performances, www.resins.com).

The external phase may contain about 3 wt % to about 40 wt %, more typically about 5 wt % to about 20 wt % of mono or poly glycidyl ethers of an aliphatic alcohol, aliphatic polyol, polyesterpolyol or polyetherpolyol.

The external phase may include one or more oxetane-functional components ("oxetanes"). Oxetanes are components having one or more oxetane groups, i.e., one or more four-member ring structures including one oxygen and three carbon members.

Examples of oxetanes include components represented by the following formula:

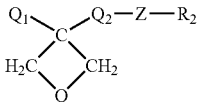

wherein

Q1 represents a hydrogen atom, an alkyl group having 1 to 6 carbon atoms (such as a methyl, ethyl, propyl, or butyl group), a fluoroalkyl group having 1 to 6 carbon atoms, an allyl group, an aryl group, a furyl group, or a thienyl group;

Q2 represents an alkylene group having 1 to 6 carbon atoms (such as a methylene, ethylene, propylene, or butylene group), or an alkylene group containing an ether linkage, for example, an oxyalkylene group, such as an oxyethylene, oxypropylene, or oxybutylene group;

Z represents an oxygen atom or a sulfur atom; and

R2 represents a hydrogen atom, an alkyl group having 1-6 carbon atoms (e.g., a methyl group, ethyl group, propyl group, or butyl group), an alkenyl group having 2-6 carbon atoms (e.g., a 1-propenyl group, 2-propenyl group, 2-methyl-1-propenyl group, 2-methyl-2-propenyl group, 1-butenyl group, 2-butenyl group, or 3-butenyl group), an aryl group having 6-18 carbon atoms (e.g., a phenyl group, naphthyl group, anthranyl group, or phenanthryl group), a substituted or unsubstituted aralkyl group having 7-18 carbon atoms (e.g., a benzyl group, fluorobenzyl group, methoxy benzyl group, phenethyl group, styryl group, cynnamyl group, ethoxybenzyl group), an aryloxyalkyl group (e.g., a phenoxymethyl group or phenoxyethyl group), an alkylcarbonyl group having 2-6 carbon atoms (e.g., an ethylcarbonyl group, propylcarbonyl group, or butylcarbonyl group), an alkoxy carbonyl group having 2-6 carbon atoms (e.g., an ethoxycarbonyl group, propoxycarbonyl group, or butoxycarbonyl group), an N-alkylcarbamoyl group having 2-6 carbon atoms (e.g., an ethylcarbamoyl group, propylcarbamoyl group, butylcarbamoyl group, or pentylcarbamoyl group), or a polyether group having 2-1000 carbon atoms. One particularly useful oxetane includes 3-ethyl-3-(2-ethylhexyloxymethyl) oxetane.

In addition to or instead of one or more cationically curable components, the external phase may include one or more free radical curable components, e.g., one or more free radical polymerizable components having one or more ethylenically unsaturated groups, such as (meth)acrylate (i.e., acrylate or methacrylate) functional components.

An example of a monofunctional ethylenically unsaturated component includes acrylamide, N,N-dimethylacrylamide, (meth)acryloylmorpholine, 7-amino-3,7-dimethyloctyl (meth)acrylate, isobutoxymethyl(meth)acrylamide, isobornyloxyethyl (meth)acrylate, isobornyl(meth)acrylate, 2-ethylhexyl(meth)acrylate, ethyldiethylene glycol (meth) acrylate, t-octyl(meth)acrylamide, diacetone (meth)acrylamide, dimethylaminoethyl(meth)acrylate, diethylaminoethyl (meth)acrylate, lauryl (meth)acrylate, dicyclopentadiene (meth)acrylate, dicyclopentenyloxyethyl (meth)acrylate, dicyclopentenyl(meth)acrylate, N,N-dimethyl(meth)acrylamidetetrachlorophenyl (meth)acrylate, 2-tetrachlorophenoxyethyl (meth)acrylate, tetrahydrofurfuryl(meth)acrylate, tetrabromophenyl(meth)acrylate, 2-tetrabromophenoxyethyl (meth)acrylate, 2-trichlorophenoxyethyl(meth)acrylate, tribromophenyl(meth)acrylate, 2-tribromophenoxyethyl(meth) acrylate, 2-hydroxyethyl (meth)acrylate, 2-hydroxypropyl (meth)acrylate, vinylcaprolactam, N-vinylpyrrolidone, phenoxyethyl(meth)acrylate, butoxyethyl(meth)acrylate, pentachlorophenyl (meth)acrylate, pentabromophenyl(meth) acrylate, polyethylene glycol mono(meth)acrylate, polypropylene glycol mono(meth)acrylate, bornyl(meth)acrylate, methyltriethylene diglycol (meth)acrylate, or a combination thereof.

An examples of the polyfunctional ethylenically unsaturated component includes ethylene glycol di(meth)acrylate, dicyclopentenyl di(meth)acrylate, triethylene glycol diacrylate, tetraethylene glycol di(meth)acrylate, tricyclodecanediyldimethylene di(meth)acrylate, trimethylolpropane tri(meth)acrylate, ethoxylated trimethylolpropane tri(meth) acrylate, propoxylated trimethylolpropane tri(meth)acrylate, tripropylene glycol di(meth)acrylate, neopentyl glycol di(meth)acrylate, both-terminal (meth)acrylic acid adduct of bisphenol A diglycidyl ether, 1,4-butanediol di(meth)acrylate, 1,6-hexanediol di(meth)acrylate, polyethylene glycol di(meth)acrylate, (meth)acrylate-functional pentaerythritol derivatives (e.g., pentaerythritol tri(meth)acrylate, pentaerythritol tetra(meth)acrylate, dipentaerythritol hexa(meth) acrylate, dipentaerythritol penta(meth)acrylate, or dipentaerythritol tetra(meth)acrylate), ditrimethylolpropane tetra (meth)acrylate, ethoxylated bisphenol A di(meth)acrylate, propoxylated bisphenol A di(meth)acrylate, ethoxylated hydrogenated bisphenol A di(meth)acrylate, propoxylated-modified hydrogenated bisphenol A di(meth)acrylate, ethoxylated bisphenol F di(meth)acrylate, or a combination thereof.

In one embodiment, the binder formulation comprises one or more components having at least 3 (meth)acrylate groups, for example, 3 to 6 (meth)acrylate groups or 5 to 6 (meth) acrylate groups.

In particular embodiments, the external phase includes, relative to the total weight of the composite binder formulation, at least about 3 wt % of one or more free radical polymerizable components, for example, at least about 5 wt % or at least about 9 wt %. Generally, the external phase includes not greater than about 50 wt % of free radical polymerizable components, for example, not greater than about 35 wt %, not greater than about 25 wt %, not greater than about 20 wt %, or not greater than about 15 wt %.

Generally, the polymer reaction constituents or precursors have on average at least two functional groups, such as on average at least 2.5 or at least 3.0 functional groups. For example, an epoxy precursor may have 2 or more epoxy-functional groups. In another example, an acrylic precursor may have two or more methacrylate functional groups.

It has surprisingly been found that an external phase including a component having a polyether backbone shows excellent mechanical properties after cure of the composite binder formulation. An example of a compound having a polyether backbone includes polytetramethylenediol, a glycidylether of polytetramethylenediol, an acrylate of polytetramethylenediol, a polytetramethylenediol containing one or more polycarbonate groups, or a combination thereof. In an embodiment, the external phase includes between 5 wt % and 20 wt % of a compound having a polyether backbone.

The external phase may also include catalysts and initiators. For example, a cationic initiator may catalyze reactions between cationic polymerizable constituents. A radical initiator may activate free-radical polymerization of radiacally polymerizable constituents. The initiator may be activated by thermal energy or actinic radiation. For example, an initiator may include a cationic photoinitiator that catalyzes cationic polymerization reactions when exposed to actinic radiation. In another example, the initiator may include a radical photoinitiator that initiates free-radical polymerization reactions when exposed to actinic radiation. Actinic radiation includes particulate or non-particulate radiation and is intended to include electron beam radiation and electromagnetic radiation. In a particular embodiment, electromagnetic radiation includes radiation having at least one wavelength in the range of about 100 nm to about 700 nm and, in particular, wavelengths in the ultraviolet range of the electromagnetic spectrum.

Generally, cationic photoinitiators are materials that form active species that, if exposed to actinic radiation, are capable of at least partially polymerizing epoxides or oxetanes. For example, a cationic photoinitiator may, upon exposure to actinic radiation, form cations that can initiate the reactions of cationically polymerizable components, such as epoxies or oxetanes.

An example of a cationic photoinitiator includes, for example, onium salt with anions of weak nucleophilicity. An example includes a halonium salt, an iodosyl salt or a sulfonium salt, such as described in published European patent application EP 153904 and WO 98/28663, a sulfoxonium salt, such as described, for example, in published European patent applications EP 35969, 44274, 54509, and 164314, or a diazonium salt, such as described, for example, in U.S. Pat. Nos. 3,708,296 and 5,002,856. All eight of these disclosures are hereby incorporated in their entirety by reference. Other examples of cationic photoinitiators include metallocene salt, such as described, for example, in published European applications EP 94914 and 94915, which applications are both hereby incorporated in their entirety by reference.

In exemplary embodiments, the external phase includes one or more photoinitiators represented by the following formula (2) or (3):

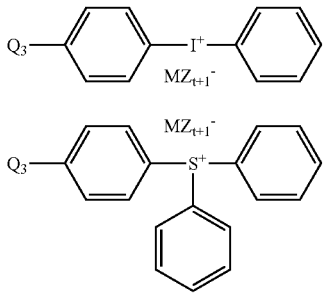

(2)

(3)

wherein

Q3 represents a hydrogen atom, an alkyl group having 1 to 18 carbon atoms, or an alkoxyl group having 1 to 18 carbon atoms;

M represents a metal atom, e.g., antimony;

Z represents a halogen atom, e.g., fluorine; and t is the valent number of the metal, e.g., 5 in the case of antimony.

In particular examples, the external phase includes, relative to the total weight of the composite binder formulation, about 0.1 wt % to about 15 wt % of one or more cationic photoinitiators, for example, about 1 wt % to about 10 wt %.

Typically, an onium salt photoinitiator includes an iodonium complex salt or a sulfonium complex salt. Useful aromatic onium complex salts are further described, for example, in U.S. Pat. No. 4,256,828 (Smith), the disclosure of which is incorporated herein by reference. An exemplary aromatic iodonium complex salt includes a diaryliodonium hexafluorophosphate or a diaryliodonium hexafluoroantimonate. An exemplary aromatic sulfonium complex salt includes a triphenylsulfonium hexafluoroantimonate p-phenyl(thiophenyl) diphenylsulfonium hexafluoroantimonate, or a sulfonium (thiodi-4,1-phenylene)bis(diphenyl-bis((OC-6-11)hexafluoroantimonate)).

Aromatic onium salts are typically photosensitive only in the ultraviolet region of the spectrum. However, they can be sensitized to the near ultraviolet and the visible range of the spectrum by sensitizers for known photolyzable organic halogen compounds. An exemplary sensitizer includes an aromatic amine or a colored aromatic polycyclic hydrocarbon, as described, for example, in U.S. Pat. No. 4,250,053 (Smith), the disclosure of which is incorporated herein by reference.

A suitable photoactivatable organometallic complex salt includes those described, for example, in U.S. Pat. No. 5,059,701 (Keipert); U.S. Pat. No. 5,191,101 (Palazzotto et al.); and U.S. Pat. No. 5,252,694 (Willett et al.), the disclosures of which are incorporated herein by reference. An exemplary organometallic complex salt useful as photoactivatable intiators includes: ($\eta^6$-benzene)($\eta^5$-cyclopentadienyl)$Fe^{+1}SbF_6^-$, ($\eta^6$-toluene) ($\eta^5$-cyclopentadienyl)$Fe^{+1}AsF_6^-$, ($\eta^6$-xylene) ($\eta^5$-cyclopentadienyl)$Fe^{+1}SbF_6^-$, ($\eta^6$-cumene)($\eta^5$-cyclopentadienyl) $Fe^{+1}PF_6^-$, ($\eta^6$-xylenes (mixed isomers)) ($\eta^5$-cyclopentadienyl)-$Fe^{+1}SbF_6^-$, ($\eta^6$- xylenes (mixed isomers)) ($\eta^5$- cyclopentadienyl)$Fe^{+1}PF_6^-$, ($\eta^6$-o-xylene)($\eta^5$-cyclopentadienyl) $Fe^{+1}$ $CF_3SO_3^-$, ($\eta^6$m-xylene)($\eta^5$-cyclopentadienyl) $Fe^{+1}$ $BF_4^-$, ($\eta^6$- mesitylene) ($\eta^5$-cyclopentadienyl) $Fe^{+1}SbF_6^-$, ($\eta^6$-hexamethylbenzene) ($\eta^5$-cyclopentadienyl) $Fe^{+1}SbF_5OH^-$, ($\eta^6$- fluorene)($\eta^5$-cyclopentadienyl) $Fe^{+1}SbF_6^-$, or a combination thereof.

Optionally, organometallic salt catalysts can be accompanied by an accelerator, such as an oxalate ester of a tertiary alcohol. If present, the accelerator desirably comprises from about 0.1% to about 4% by weight of the total binder formulation.

A useful commercially available cationic photoinitiator includes an aromatic sulfonium complex salt, available, for example, under the trade designation "FX-512" from Minnesota Mining and Manufacturing Company, St. Paul, Minn., an aromatic sulfonium complex salt having the trade designation "UVI-6974", available from Dow Chemical Co., or Chivacure 1176.

The external phase may optionally include photoinitiators useful for photocuring free-radically polyfunctional acrylates. An example of a free radical photoinitiator includes benzophenone (e.g., benzophenone, alkyl-substituted benzophenone, or alkoxy-subsituted benzophenone); benzoin (e.g., benzoin, benzoin ethers, such as benzoin methyl ether, benzoin ethyl ether, and benzoin isopropyl ether, benzoin phenyl ether, and benzoin acetate); acetophenone, such as acetophenone, 2,2-dimethoxyacetophenone, 4-(phenylthio) acetophenone, and 1,1-dichloroacetophenone; benzil ketal, such as benzil dimethyl ketal, and benzil diethyl ketal; anthraquinone, such as 2-methylanthraquinone, 2-ethylanthraquinone, 2-tertbutylanthraquinone, 1-chloroanthraquinone, and 2-amylanthraquinone; triphenylphosphine; benzoylphosphine oxides, such as, for example, 2,4,6-trimethylbenzoyldiphenylphosphine oxide; thioxanthone or xanthone; acridine derivative; phenazene derivative; quinoxaline derivative; 1-phenyl-1,2-propanedione-2-O-benzoyloxime; 1-aminophenyl ketone or 1-hydroxyphenyl ketone, such as 1-hydroxycyclohexyl phenyl ketone, phenyl(1-hydroxyisopropyl)ketone and 4-isopropylphenyl(1-hydroxyisopropyl) ketone; or a triazine compound, for example, 4'''-methyl thiophenyl-1-di(trichloromethyl)-3,5-S-triazine, S-triazine-2-(stilbene)-4,6-bistrichloromethyl, or paramethoxy styryl triazine.

An exemplary photoinitiator includes benzoin or its derivative such as α-methylbenzoin; U-phenylbenzoin; α-allylbenzoin; α-benzylbenzoin; benzoin ethers such as benzil dimethyl ketal (available, for example, under the trade designation "IRGACURE 651" from Ciba Specialty Chemicals), benzoin methyl ether, benzoin ethyl ether, benzoin n-butyl ether; acetophenone or its derivative, such as 2-hydroxy-2-methyl-1-phenyl-1-propanone (available, for example, under the trade designation "DAROCUR 1173" from Ciba Specialty Chemicals) and 1-hydroxycyclohexyl phenyl ketone (available, for example, under the trade designation "IRGACURE 184" from Ciba Specialty Chemicals); 2-methyl-1-[4-(methylthio)phenyl]-2-(4-morpholinyl)-1-propanone (available, for example, under the trade designation "IRGACURE 907" from Ciba Specialty Chemicals); 2-benzyl-2-(dimethlamino)-1-[4-(4-morpholinyl)phenyl]-1-butanone (available, for example, under the trade designation "IRGACURE 369" from Ciba Specialty Chemicals); or a blend thereof.

Another useful photoinitiator includes pivaloin ethyl ether, anisoin ethyl ether; anthraquinones, such as anthraquinone, 2-ethylanthraquinone, 1-chloroanthraquinone, 1,4-dimethylanthraquinone, 1-methoxyanthraquinone, benzanthraquinonehalomethyltriazines, and the like; benzophenone or its derivative; iodonium salt or sulfonium salt as described hereinabove; a titanium complex such as bis(η5-2,4-cyclopentadienyl)bis[2,-6-difluoro-3-(1H-pyrrolyl)phenyl)titanium (commercially available under the trade designation "CGI784DC", also from Ciba Specialty Chemicals); a halomethylnitrobenzene such as 4-bromomethylnitrobenzene and the like; or mono- or bis-acylphosphine (available, for example, from Ciba Specialty Chemicals under the trade designations "IRGACURE 1700", "IRGACURE 1800", "IRGACURE 1850", and "DAROCUR 4265"). A suitable photoinitiator may include a blend of the above mentioned species, such as α-hydroxy ketone/acrylphosphin oxide blend (available, for example, under the trade designation IRGACURE 2022 from Ciba Specialty Chemicals.)

A further suitable free radical photoinitiator includes an ionic dye-counter ion compound, which is capable of absorbing actinic rays and producing free radicals, which can initiate the polymerization of the acrylates. See, for example, published European Patent Application 223587, and U.S. Pat. Nos. 4,751,102, 4,772,530 and 4,772,541, all four of which are hereby incorporated in their entirety by reference.

A photoinitiator can be present in an amount not greater than about 20 wt %, for example, not greater than about 10 wt %, and typically not greater than about 5 wt %, based on the total weight of the binder formulation. For example, a photoinitiator may be present in an amount of 0.1 wt % to 20.0 wt %, such as 0.1 wt % to 5.0 wt %, or most typically 0.1 wt % to 2.0 wt %, based on the total weight of the binder formulation, although amounts outside of these ranges may also be useful. In one example, the photoinitiator is present in an amount at least about 0.1 wt %, such as at least about 1.0 wt % or in an amount 1.0 wt % to 10.0 wt %.

Optionally, a thermal curative may be included in the external phase. Such a thermal curative is generally thermally stable at temperatures at which mixing of the components takes place. Exemplary thermal curatives for epoxy resins and acrylates are well known in the art, and are described, for example, in U.S. Pat. No. 6,258,138 (DeVoe et al.), the disclosure of which is incorporated herein by reference. A thermal curative may be present in a binder precursor in any effective amount. Such amounts are typically in the range of about 0.01 wt % to about 5.0 wt %, desirably in the range from about 0.025 wt % to about 2.0 wt % by weight, based upon the weight of the binder formulation, although amounts outside of these ranges may also be useful.

The external phase may also include other components such as solvents, plasticizers, crosslinkers, chain transfer agents, stabilizers, dispersants, curing agents, reaction mediators and agents for influencing the fluidity of the dispersion. For example, the external phase can also include one or more chain transfer agents selected from the group consisting of polyol, polyamine, linear or branched polyglycol ether, polyester and polylactone.

In another example, the external phase may include additional components, such as a hydroxy-functional or an amine functional component and additive. Generally, the particular hydroxy-functional component is absent curable groups (such as, for example, acrylate-, epoxy-, or oxetane groups) and are not selected from the group consisting of photoinitiators.

The external phase may include one or more hydroxy-functional components. Hydroxy-functional components may be helpful in further tailoring mechanical properties of the binder formulation upon cure. An hydroxy-functional component includes monol (a hydroxy-functional component comprising one hydroxy group) or polyol (a hydroxy-functional component comprising more than one hydroxy group).

A representative example of a hydroxy-functional component includes an alkanol, a monoalkyl ether of polyoxyalkyleneglycol, a monoalkyl ether of alkyleneglycol, alkylene and arylalkylene glycol, such as 1,2,4-butanetriol, 1,2,6-hexanetriol, 1,2,3-heptanetriol, 2,6-dimethyl-1,2,6-hexanetriol, (2R,3R)-(−)-2-benzyloxy-1,3,4-butanetriol, 1,2,3-hexanetriol, 1,2,3-butanetriol, 3-methyl-1,3,5-pentanetriol, 1,2,3-cyclohexanetriol, 1,3,5-cyclohexanetriol, 3,7,11,15-tetramethyl-1,2,3-hexadecanetriol, 2-hydroxymethyltetrahydropyran-3,4,5-triol, 2,2,4,4-tetramethyl-1,3-cyclobutanediol, 1,3-cyclopentanediol, trans-1,2-cyclooctanediol, 1,16-hexadecanediol, 3,6-dithia-1,8-octanediol, 2-butyne-1,4-diol, 1,2- or 1,3-propanediol, 1,2- or 1,4-butanediol, 1,5-pentanediol, 1,6-hexanediol, 1,7-heptanediol, 1,8-octanediol, 1,9-nonanediol, 1-phenyl-1,2-ethanediol, 1,2-cyclohexanediol, 1,5-decalindiol, 2,5-dimethyl-3-hexyne-2,5-diol, 2,2,4-trimethylpentane-1,3-diol, neopentylglycol, 2-ethyl-1,3-hexanediol, 2,7-dimethyl-3,5-octadiyne-2-7-diol, 2,3-butanediol, 1,4-cyclohexanedimethanol, polyoxyethylene or polyoxypropylene glycols or triols of molecular weights from about 200 to about 10,000, polytetramethylene glycols of varying molecular weight, poly(oxyethylene-oxybutylene) random or block copolymers, copolymers containing pendant hydroxy groups formed by hydrolysis or partial hydrolysis of vinyl acetate copolymers, polyvinylacetal resins containing pendant hydroxyl groups, hydroxy-functional (e.g., hydroxy-terminated) polyesters or hydroxy-functional (e.g., hydroxy-terminated) polylactones, aliphatic polycarbonate polyols (e.g., an aliphatic polycarbonate diol), hydroxy-functional (e.g., hydroxy-terminated) polyethers (e.g., polytetrahydrofuran polyols having a number average molecular weight in the range of 150-4000 g/mol, 150-1500 g/mol, or 150-750 g/mol), or a combination thereof. An exemplary polyol further includes aliphatic polyol, such as glycerol, trimethylolpropane, or also sugar alcohol, such as erythritol, xylitol, mannitol or sorbitol. In particular embodiments, the external phase of the binder formulation includes one or more alicyclic polyols, such as 1,4-cyclohexane-dimethanol, sucrose, or 4,8-bis(hydroxymethyl)tricyclo(5,2,1,0)decane.

A suitable polyether for the external phase includes, in particular, linear or branched polyglycol ether obtainable by ring-opening polymerization of cyclic ether in the presence of polyol, e.g., the aforementioned polyol; polyglycol ether, polyethylene glycol, polypropylene glycol or polytetramethylene glycol or a copolymer thereof.

Another suitable polyester for the external phase of the formulation includes a polyester based on polyols and aliphatic, cycloaliphatic or aromatic polyfunctional carboxylic acids (for example, dicarboxylic acids), or specifically all corresponding saturated polyesters which are liquid at temperatures of 18° C. to 300° C., typically 18° C. to 150° C.: typically succinic ester, glutaric ester, adipic ester, citric ester, phthalic ester, isophthalic ester, terephthalic ester or an ester of corresponding hydrogenation products, with the alcohol component being composed of monomeric or polymeric polyols, for example, of those of the above-mentioned kind.

A further polyester includes aliphatic polylactone, such as α-polycaprolactone, or polycarbonate, which, for example, are obtainable by polycondensation of diol with phosgene. For the external phase it is typical to use polycarbonate of bisphenol A having an average molecular weight of from 500 to 100,000.

For the purpose of influencing the viscosity of the external phase and, in particular, viscosity reduction or liquefaction, the polyol, polyether or saturated polyester or mixtures thereof may, where appropriate, be admixed with a further suitable auxiliary, particularly a solvent, a plasticizer, a diluent or the like. In an embodiment, the compositions may comprise, relative to the total weight of the binder formulation, not greater than about 15 wt %, such as not greater than about 10 wt %, not greater than about 6 wt %, not greater than about 4 wt %, not greater than about 2 wt %, or about 0 wt % of a hydroxy-functional component. In one example, the binder formulations are free of substantial amounts of a hydroxy-functional component. The absence of substantial amounts of hydroxy-functional components may decrease the hygroscopicity of the binder formulations or articles obtained therewith.

An example of a hydroxy or an amine functional organic compound for making condensation product with an alkylene oxide includes a polyol having 3 to 20 carbon atoms, a (C8-C18) fatty acid (C1-C8)alkanol amides like fatty acid ethanol amides, a fatty alcohol, an alkylphenol or a diamine having 2 to 5 carbon atoms. Such compounds are reacted with alkylene oxide, such as ethylene oxide, propylene oxide or mixtures thereof. The reaction may take place in a molar ratio of hydroxy or amine containing organic compound to alkyleneoxide of, for example, 1:2 to 1:65. The condensation product typically has a weight average molecular weight of about 500 to about 10,000, and may be branched, cyclic, linear, and either a homopolymer, a copolymer or a terpolymer.

The external phase may further include a dispersant for interacting with and modifying the surface of the particulate filler. For example, a dispersant may include organosiloxane, functionalized organisiloxane, alkyl-substituted pyrrolidone, polyoxyalkylene ether, ethyleneoxide propyleneoxide copolymer or a combination thereof. For various particulate fillers and, in particular, for silica filler, a suitable surface modifier includes siloxane.

An example of siloxane includes functionalized or non-functionalized siloxane. An example of a siloxane includes a compound represented by the formula,

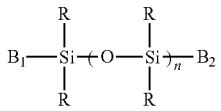

wherein each R is independently a substituted or unsubstituted linear, branched or cyclic C1-10 alkyl, C1-10 alkoxy, substituted or unsubstituted aryl, aryloxy, trihaloalkyl, cyanoalkyl or vinyl group; wherein B1 or B2 is a hydrogen, siloxy group, vinyl, silanol, alkoxy, amine, epoxy, hydroxy, (meth)acrylate, mercapto or solvent phobic groups such as lipophilic or hydrophilic (e.g., anionic, cationic) groups; and wherein n is an integer from about 1 to about 10,000, particularly from about 1 to about 100.

In general, the functionalized siloxane is a compound having a molecular weight ranging from about 300 to about 20,000. Such compounds are commercially available from, for example, the General Electric Company or from Goldschmidt, Inc. A typical functionalized siloxane is an amine functionalized siloxane wherein the functionalization is typically terminal to the siloxane.

Exemplary organosiloxanes are sold under the name Silwet by Witco Corporation. Such organosiloxanes typically have an average weight molecular weight of about 350 to about 15,000, are hydrogen or C1-C4 alkyl capped and may be hydrolyzable or non-hydrolyzable. Typical organosiloxanes include those sold under the name of Silwet L-77, L-7602, L-7604 and L-7605, which are polyalkylene oxide modified dialkyl polysiloxanes.

An example of a suitable anionic dispersant includes (C8-C16)alkylbenzene sulfonate, (C8-C16)alkane sulfonate, (C8-C18) α-olefin sulfonate, α-sulfo (C8-C16) fatty acid methyl ester, (C8-C16) fatty alcohol sulfate, mono- or di-alkyl sulfosuccinate with each alkyl independently being a (C8-C16) alkyl group, alkyl ether sulfate, a (C8-C16) salt of carboxylic acid or isethionate having a fatty chain of about 8 to about 18 carbons, for example, sodium diethylhexyl sulfosuccinate, sodium methyl benzene sulfonate, or sodium bis(2-ethylhexyl)sulfosuccinate (for example, Aerosol OT or AOT).

Typical, the dispersant is a compound selected from an organosiloxane, a functionalised organosiloxane, an alkyl-substituted pyrrolidone, a polyoxyalkylene ether, or a ethyleneoxide propylenenoxide block copolymer.

An example of a commercial dispersant includes a cyclic organo-silicone (e.g., SF1204, SF1256, SF1328, SF1202 (decamethyl-cyclopentasiloxane(pentamer)), SF1258, SF1528, Dow Corning 245 fluids, Dow Corning 246 fluids, dodecamethyl-cyclo-hexasiloxane (heximer), and SF 1173); a copolymer of a polydimethylsiloxane and a polyoxyalkylene oxide (e.g., SF1488 and SF1288); linear silicon comprising oligomers (e.g., Dow Corning 200 (R) fluids); Silwet L-7200, Silwet L-7600, Silwet L-7602, Silwet L-7605, Silwet L-7608, or Silwet L-7622; a nonionic surfactants (e.g., Triton X-100, Igepal CO-630, PVP series, Airvol 125, Airvol 305, Airvol 502 and Airvol 205); an organic polyether (e.g., Surfynol 420, Surfynol 440 and Surfynol 465); or Solsperse 41000.

Another exemplary commercial dispersant includes SF1173 (from GE Silicones); an organic polyether like Surfynol 420, Surfynol 440, and Surfynol 465 (from Air Products Inc); Silwet L-7200, Silwet L-7600, Silwet L-7602, Silwet L-7605, Silwet L-7608, or Silwet L-7622 (from Witco) or non-ionic surfactant such as Triton X-100 (from Dow Chemicals), Igepal CO-630 (from Rhodia), PVP series (from ISP Technologies) and Solsperse 41000 (from Avecia).

The amount of dispersant ranges from 0 wt % to 5 wt %. More typically, the amount of dispersant is between 0.1 wt % and 2 wt %. The silanes are typically used in concentrations from 40 mol % to 200 mol % and, particularly, 60 mol % to 150 mol % relative to the molecular quantity surface active sites on the surface of the nano-sized particulate filler. Generally, the binder formulation includes not greater than about 5 wt % dispersant, such as about 0.1 wt % to about 5.0 wt % dispersant, based on the total weight of the binder formulation.

In a particular embodiment, the binder formulation includes about 10 wt % to about 90 wt % cationically polymerizable compound, not greater than about 40 wt % radically polymerizable compound, and about 5 wt % to about 80 wt % particulate filler, based on the total weight of the binder formulation. It is understood that the sum of the amounts of the binder formulation components adds to 100 wt % and, as such, when amounts of one or more components are specified, the amounts of other components correspond so that the sum of the amounts is not greater than 100 wt %.

The cationically polymerizable compound, for example, includes an epoxy-functional component or a oxetane-functional component. For example, the binder formulation may include about 10 wt % to about 60 wt % cationically polymerizable compound, such as about 20 wt % to about 50 wt % cationically polymerizable compound based on the weight of the binder formulation. The exemplary binder formulation may include not greater than about 20 wt %, such as about 5 wt % to about 20 wt % mono or poly glycidyl ethers of an aliphatic alcohol, aliphatic polyols, polyesterpolyol or polyetherpolyol. The exemplary binder formulation may include not greater than about 50 wt %, such as about 5 wt % to about 50 wt % of a component having a polyether backbone, such as polytetramethylenediol, glycidylethers of polytetramethylenediol, acrylates of polytetramethylenediol or polytetramethylenediol containing one or more polycarbonate groups.

The radically polymerizable compound of the above example, for example, includes components having one or more methacylate groups, such as components having at least 3 methacrylate groups. In another example, the binder formulation includes not greater than about 30 wt %, such as not greater than about 20 wt %, not greater than about 10 wt % or not greater than about 5 wt % radically polymerizable compound.

The formulation may further include not greater than about 20 wt % cationic photoinitiator, such as about 0.1 wt % to about 20 wt %, or not greater than about 20 wt % radical photoinitiator, such as about 0.1 wt % to about 20 wt %. For example, the binder formulation may include not greater than about 10 wt %, such as not greater than about 5 wt % cationic photoinitiator. In another example, the binder formulation may include not greater than about 10 wt %, such as not greater than about 5 wt % free radical photoinitiator.

The particular filler includes dispersed submicron particulates. Generally, the binder formulation includes 5 wt % to 80 wt %, such as 5 wt % to 60 wt %, such as 5 wt % to 50 wt % or 20 wt % to 45 wt % submicron particulate filler. Particular embodiments include at least about 5 wt % particulate filler, such as at least about 10 wt % or at least about 20 wt %. In a particular embodiment, the particulate filler is solution formed silica particulate and may be colloidally dispersed in a polymer component. The exemplary binder formulation may further include not greater than about 5 wt % dispersant, such as 0.1 wt % to 5 wt % dispersant, selected from organosiloxane, functionalised organosiloxane, alkyl-substituted pyrrolidone, polyoxyalkylene ether, and ethyleneoxide propylenenoxide block copolymer.

In a particular embodiment, the binder formulation is formed by mixing a nanocomposite epoxy or acrylate precursor, i.e., a precursor including submicron particulate filler. For example, the binder formulation may include not greater than about 90 wt % nanocomposite epoxy and may include acrylic precursor, such as not greater than 50 wt % acrylic precursor. In another example, a nanocomposite acrylic precursor may be mixed with epoxy.

The binder formulation including an external phase comprising polymeric or monomeric constituents and including dispersed particulate filler may be used to form a make coat, a size coat, a compliant coat, or a back coat of a coated abrasive article. In an exemplary process for forming a make coat, the binder formulation is coated on a backing, abrasive grains are applied over the make coat, and the make coat is cured. A size coat may be applied over the make coat and abrasive grains. In another exemplary embodiment, the binder formulation is blended with the abrasive grains to form abrasive slurry that is coated on a backing and cured. Alternatively, the abrasive slurry is applied to a mold, such as injected into a mold and cured to form a bonded abrasive article.

The abrasive grains may be formed of any one of or a combination of abrasive grains, including silica, alumina (fused or sintered), zirconia, zirconia/alumina oxides, silicon carbide, garnet, diamond, cubic boron nitride, silicon nitride, ceria, titanium dioxide, titanium diboride, boron carbide, tin oxide, tungsten carbide, titanium carbide, iron oxide, chromia, flint, emery. For example, the abrasive grains may be selected from a group consisting of silica, alumina, zirconia, silicon carbide, silicon nitride, boron nitride, garnet, diamond, cofused alumina zirconia, ceria, titanium diboride, boron carbide, flint, emery, alumina nitride, and a blend thereof. Particular embodiments have been created by use of dense abrasive grains comprised principally of alpha-alumina.

The abrasive grain may also have a particular shape. An example of such a shape includes a rod, a triangle, a pyramid, a cone, a solid sphere, a hollow sphere or the like. Alternatively, the abrasive grain may be randomly shaped.

The abrasive grains generally have an average grain size not greater than 2000 microns, such as not greater than about 1500 microns. In another example, the abrasive grain size is not greater than about 750 microns, such as not greater than about 350 microns. For example, the abrasive grain size may be at least 0.1 microns, such as from about 0.1 microns to about 1500 microns, and more typically from about 0.1 microns to about 200 microns or from about 1 micron to about 100 microns. The grain size of the abrasive grains is typically specified to be the longest dimension of the abrasive grain. Generally, there is a range distribution of grain sizes. In some instances, the grain size distribution is tightly controlled.

In a blended abrasive slurry including the abrasive grains and the binder formulation, the abrasive grains provide from about 10% to about 90%, such as from about 30% to about 80%, of the weight of the abrasive slurry.

The abrasive slurry may further include a grinding aid to increase the grinding efficiency and cut rate. A useful grinding aid can be inorganic based, such as a halide salt, for example, sodium cryolite, and potassium tetrafluoroborate; or organic based, such as a chlorinated wax, for example, polyvinyl chloride. A particular embodiment includes cryolite and potassium tetrafluoroborate with particle size ranging from 1 micron to 80 microns, and most typically from 5 microns to 30 microns. The weight percent of grinding aid is generally not greater than about 50 wt %, such as from about 0 wt % to 50 wt %, and most typically from about 10 wt % to 36 wt % of the entire slurry (including the abrasive grains).

Once cured into an abrasive article, the binder generally acts to secure abrasive grains onto a backing or into a surface structure or bonded structure. The performance of the binder may be determined by forming abrasive articles using variations on binder formulations with a standard abrasive grain. In a particular example, the binder exhibits an Rz Performance not greater than about 3.0 as determined by the Rz Performance test described below in the Examples section. For example, the Rz Performance of the binder may be not greater than about 2.75, such as not greater than about 2.5 or not greater than about 1.5.

The binder may also exhibit a Stock Removal Performance at least about 0.7 gas determined by the Stock Removal Performance test described below in the Examples section. For example, the Stock Removal Performance may be at least about 0.9 g, such as at least about 1.0 g or at least about 1.1 g.

In a further example, the binder, after curing, exhibits a Young's modulus of at least about 500 MPa, such as at least about 750 MPa. For example, the binder may exhibit a Young's modulus of at least about 3100 MPa (450 ksi), at least about 4067 MPa (590 ksi), at least about 5615 MPa (815 ksi), at least about 5684 MPa (825 ksi), or at least about 6132 MPa (890 ksi). The binder, after curing, may exhibit an elongation at break of at least about 1.0%. For example, the binder may exhibit elongation at break of at least about 1.7%, at least about 2.2%, at least about 4.0%, at least about 9.0% or at least about 11.0%. In a particular example, the binder may exhibit both a Young's modulus of at least about 4065 MPa and an elongation at break of at least about 9.0%. In another example, the binder may exhibit a Young's modulus of at least about 3100 MPa and an elongation at break of at least about 11.2%. In a further example, the binder exhibits a Young's modulus at least about 5615 MPa and an elongation at break at least about 4.0%. The binder, after curing, may further exhibit a tensile strength of at least about 20 MPa, such as at least about 30 MPa or at least about 40 MPa.

FIG. 1 illustrates an exemplary embodiment of a coated abrasive article 100, which includes abrasive grains 106 secured to a backing or support member 102. Generally, the abrasive grains 106 are secured to the backing 102 by a make coat 104. The make coat 104 includes a binder, which is typically formed of a cured binder formulation.

The coated abrasive article 100 may further include a size coat 108 overlying the make coat 104 and the abrasive grains 106. The size coat 108 generally functions to further secure the abrasive grains 106 to the backing 102 and may also provide grinding aids. The size coat 108 is generally formed from a cured binder formulation that may be the same as or different from the make coat binder formulation.

The coated abrasive 100 may also, optionally, include a back coat 112. The back coat 112 functions as an anti-static layer, preventing abrasive grains from adhering to the back side of the backing 102 and preventing swarf from accumulating charge during sanding. In another example, the back coat 112 may provide additional strength to the backing 102 and may act to protect the backing 102 from environmental exposure. In another example, the back coat 112 can also act as a compliant layer. The compliant layer may act to relieve stress between the make coat 104 and the backing 102.

The backing 102 may be flexible or rigid. The backing 102 may be made of any number of various materials including those conventionally used as backings in the manufacture of coated abrasives. An exemplary flexible backing includes a polymeric film (including primed films), such as a polyolefin film (e.g., polypropylene including biaxially oriented polypropylene), a polyester film (e.g., polyethylene terephthalate), a polyamide film, a cellulose ester film, a metal foil, a mesh, a foam (e.g., natural sponge material or polyurethane foam), a cloth (e.g., cloth made from fibers or yarns comprising polyester, nylon, silk, cotton, poly-cotton or rayon), a paper, a vulcanized paper, a vulcanized rubber, a vulcanized fiber, a nonwoven material, or combinations thereof, or treated versions thereof. A cloth backing may be woven or stitch bonded. In particular examples, the backing 102 is selected from a group consisting of paper, polymer film, cloth, cotton, poly-cotton, rayon, polyester, poly-nylon, vulcanized rubber, vulcanized fiber, metal foil and a combination thereof. In other examples, the backing 102 includes polypropylene film or polyethylene terephthalate (PET) film.

The backing 102 may optionally have at least one of a saturant, a presize layer or a backsize layer. The purpose of these layers is typically to seal the backing 102 or to protect yarn or fibers in the backing 102. If the backing 102 is a cloth material, at least one of these layers is, typically used. The addition of the presize layer or backsize layer may additionally result in a "smoother" surface on either the front or the back side of the backing. Other optional layers known in the art may also be used (e.g. a tie layer; see, for example, U.S. Pat. No. 5,700,302 (Stoetzel et al.), the disclosure of which is incorporated by reference).

An antistatic material may be included in cloth treatment materials. The addition of an antistatic material can reduce the tendency of the coated abrasive article to accumulate static electricity when sanding wood or wood-like materials. Additional details regarding antistatic backings and backing treatments can be found in, for example, U.S. Pat. No. 5,108,463 (Buchanan et al.); U.S. Pat. No. 5,137,542 (Buchanan et al.); U.S. Pat. No. 5,328,716 (Buchanan); and U.S. Pat. No. 5,560,753 (Buchanan et al.), the disclosures of which are incorporated herein by reference.

The backing 102 may be a fibrous reinforced thermoplastic such as described, for example, in U.S. Pat. No. 5,417,726 (Stout et al.), or an endless spliceless belt, as described, for example, in U.S. Pat. No. 5,573,619 (Benedict et al.), the disclosures of which are incorporated herein by reference. Likewise, the backing 102 may be a polymeric substrate having hooking stems projecting therefrom such as that described, for example, in U.S. Pat. No. 5,505,747 (Chesley et al.), the disclosure of which is incorporated herein by reference. Similarly, the backing 102 may be a loop fabric such as that described, for example, in U.S. Pat. No. 5,565,011 (Follett et al.), the disclosure of which is incorporated herein by reference.

In another example, a pressure-sensitive adhesive is incorporated onto the back side of the coated abrasive article such that the resulting coated abrasive article can be secured to a pad. An exemplary pressure-sensitive adhesive includes latex crepe, rosin, acrylic polymer or copolymer including polyacrylate ester (e.g., poly(butyl acrylate)), vinyl ether (e.g., poly(vinyl n-butyl ether)), alkyd adhesive, rubber adhesive (e.g., natural rubber, synthetic rubber, and chlorinated rubber), or a mixture thereof.

An exemplary rigid backing includes metal plate, ceramic plate, or the like. Another example of a suitable rigid backing is described, for example, in U.S. Pat. No. 5,417,726 (Stout et al.), the disclosure of which is incorporated herein by reference.

Coated abrasive articles, such as the coated abrasive article 100 of FIG. 1, may be formed by coating a backing with a binder formulation or abrasive slurry. Optionally, the backing may be coated with a compliant coat or back coat prior to coating with the make coat. Typically, the binder formulation is applied to the backing to form the make coat. In one embodiment, the abrasive grains are applied with the binder formulation, wherein the abrasive grains are blended with the binder formulation to form abrasive slurry prior to application to the backing. Alternatively, the binder formulation is applied to the backing to form the make coat and the abrasive grains are applied to the make coat, such as through electrostatic and pneumatic methods. The binder formulation is cured such as through thermal methods or exposure to actinic radiation.

Optionally, a size coat is applied over the make coat and abrasive grains. The size coat may be applied prior to curing the make coat, the make coat and size coat being cured simultaneously. Alternatively, the make coat is cured prior to application of the size coat and the size coat is cured separately.

The binder formulation forming the make coat, the size coat, the compliant coat or the back coat may include colloidal binder formulation. The colloidal binder formulation may include sub-micron particulate filler, such as nano-sized particulate filler having a narrow particle size distribution. In a particular embodiment, the colloidal binder formulation is cured to form the size coat. In another embodiment, the colloidal binder formulation is cured to form the make coat. Alternatively, the colloidal binder formulation may be cured to form the optional compliant coat or the optional back coat.

In particular embodiments, the coats and abrasive grains may be patterned to form structures. For example, the make coat may be patterned to form surface structures that enhance abrasive article performance. Patterns may be pressed or rolled into the coats using, for example, a rotogravure apparatus to form a structured or engineered abrasive article.

Figure 2:
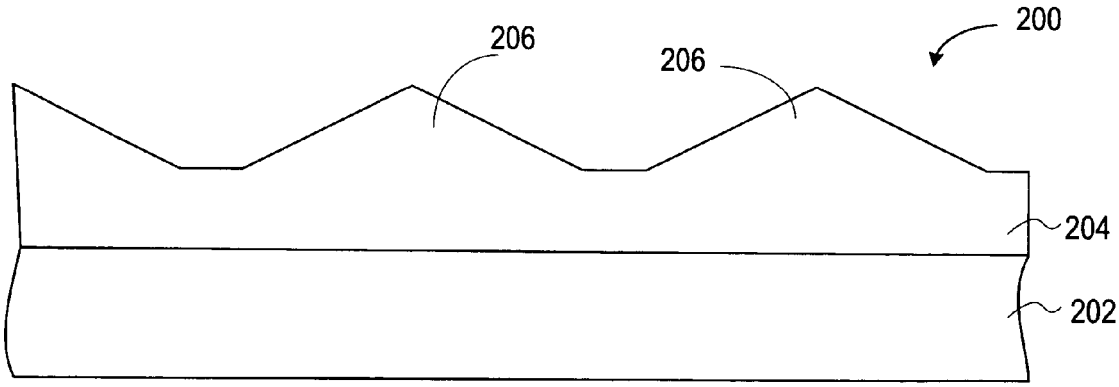
FIG. 2 includes an illustration of an exemplary structured abrasive article.

An exemplary embodiment of an engineered or structured abrasive is illustrated in FIG. 2. Structured abrasives are coated abrasives including shaped structures disposed on a backing. Exemplary structured abrasives are disclosed in U.S. Pat. No. 6,293,980, which is hereby incorporated by reference in its entirety. The structured abrasive includes a backing 202 and a layer 204 including abrasive grains. The backing 202 may be formed of the materials described above in relation to the backing 102 of FIG. 1. Generally, the layer 204 is patterned to have surface structures 206.

The layer 204 may be formed as one or more coats. For example, the layer 204 may include a make coat and optionally a size coat. The layer 204 generally includes abrasive grains and a binder. In one exemplary embodiment, the abrasive grains are blended with the binder formulation to form abrasive slurry. Alternatively, the abrasive grains are applied to the binder after the binder is coated on the backing 202. Optionally, a functional powder may be applied over the layer 204 to prevent the layer 204 from sticking to the patterning tooling.

The binder of the make coat or the size coat may be a colloidal binder, wherein the formulation that is cured to form the binder is a colloidal suspension including particulate filler. Alternatively, or in addition, the binder is a nanocomposite binder including sub-micron particulate filler.

The structured abrasive article 200 may optionally include compliant and back coats (not shown). These coats may function as described above.

Figure 3:
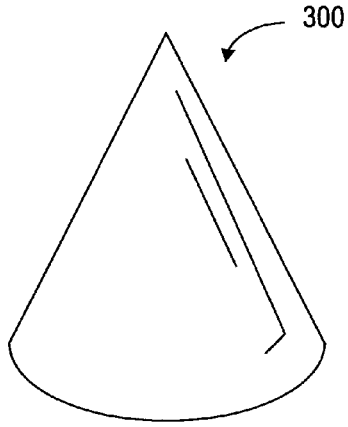
FIG. 3 includes an illustration of an exemplary bonded abrasive article.

In a further example, colloidal binder formulations may be used to form bonded abrasive articles, such as the abrasive article 300 illustrated in FIG. 3. In a particular embodiment, colloidal binder formulation and abrasive grains are blended to form abrasive slurry. The abrasive slurry is applied to a mold and the colloidal binder formulation is cured. The resulting abrasive article, such as article 300, includes the abrasive grains bound by nano-composite binder in a desired shape.

In a particular embodiment, the abrasive article is formed by blending nanocomposite precursors with other polymeric precursors and constituents. For example, a nanocomposite epoxy precursor including nano-sized particulate filler and epoxy precursors is mixed with acrylic precursors to form a nanocomposite binder formulation. The binder formulation is applied to a substrate, such as a backing or to a mold. Abrasive grains are also applied to the substrate and the binder formulation is cured.

When the nanocomposite binder forms a make coat for a coated abrasive article, the nanocomposite binder formulation may be applied to a backing and abrasive grains applied over the formulation. Alternatively, the binder formulation may be applied over the abrasive grains to form a size coat. In another example, the binder formulation and the abrasive grains may be blended and applied simultaneously to form a make coat over a substrate or to fill a mold. Generally, the binder formulation may be cured using thermal energy or actinic radiation, such as ultraviolet radiation.

Embodiments of the above described binder formulation, binder, abrasive articles, and methods for forming same are particularly advantageous. For example, abrasive articles formed of binder formulations described above may exhibit low abrasive grain loss, leading to improved surface quality. For example, when fine abrasive grains, such as abrasive grains not greater than 200 microns, are used, optical quality of lenses and glossy finish on metal works are improved. In addition, certain embodiments improve abrasive article life, leading to a reduction in the cost of grind and polishing steps and, thus, reducing product costs.

EXAMPLES

Binder performance is determined by testing binder formulations in a standardized abrasive article configuration. In a particular test, the binder formulation is used as a size coat over abrasive grains and a make coat. The abrasive grains are 80 micron heat treated semi-friable aluminum oxide from Treibacher (BFRPL)P180 grit and the make coat is formed of UV-curable acrylate. The abrasive grains and make coat overlie a polyester backing.

An abrasive tape having dimensions 1 inch by 30 inches is placed in a microfinisher test apparatus. A 1.983 inch diameter workpiece ring formed of 1045 steel is inserted into the apparatus. During testing the workpiece rotates about its central axis in both directions and also oscillates back and forth along the central axis. Mineral seal oil is applied to the workpiece as a coolant. A shoe formed of segmented India stone supplied by IMPCO provides back support to the abrasive tape. The microfinisher settings include the driver motor key set at 1.25, the number of revolutions set at 14, the oscillation motor key set at 2.5 and the pressure set at 75 psi. These conditions provide a cycle time of approximately 5 seconds at 210 RPM and a 5 HZ oscillation.

Prior to testing the workpiece rings are preconditioned using a 100 micron film (Q151) and then washed using a non-abrasive cleaner and are air-dried. An initial measurement of the ring and ring surface is taken. The weight of the ring is measured using a Toledo PB 303 scale. The surface quality is measured using a Taylor-Hobson Surtronic 3+. The rings are mounted into the apparatus and the abrasive tape is inserted. The rings are ground for 5 seconds in each direction and are then washed and measured.

The Rz Performance and Stock Removal Performance of the binder are determined by the Rz of the ring surface and stock removed from the ring. Rz is the average maximum height of a surface. Rz Performance measures the affect of binder formulation on workpiece Rz measurements. Stock Removal Performance measures the affect of binder formulation on stock removal rates. Alternatively, stock removal may be indicated by a decrease in the diameter of the ring.

Example 1

This example illustrates the influence of particulate filler loading on binder performance, such as Rz Performance and Stock Removal Performance. Size coats on sample abrasive articles are formed from binder formulations including Nanopox XP 22/0314 available from Hanse Chemie, an epoxy resin including 3,4-epoxy cyclohexyl methyl-3,4-epoxy cyclohexyl carboxylate and 40 wt % colloidal silica particulate filler. The binder formulations also include UVR 6105, which includes 3,4-epoxy cyclohexyl methyl-3,4-epoxy cyclohexyl carboxylate and no particulate filler. The binder formulations further include a polyol (4,8-bis(hydroxymethyl)tricyclo(5.2.1.0)decane), a cationic photoinitiator (Chivacure 1176), a radical photoinitiator (Irgacure 2022, available from Ciba®), and acrylate precursor (SR 399, a dipentaerythritol pentaacrylate available from Atofina-Sartomer, Exton, Pa.). Table 1 illustrates the concentration of components in the binder formulations and the resulting Rz and Stock Removal Performance.

TABLE 1

| | 1.1 Wt % | 1.2 Wt % | 1.3 Wt % | 1.4 Wt % | 1.5 Wt % |
|---|---|---|---|---|---|
| INGREDIENT | | | | | |
| Nanopox XP 22/0314 | 0.00 | 20.00 | 40.00 | 60.00 | 79.92 |
| UVR 6105 | 79.92 | 59.92 | 39.92 | 19.92 | 0.00 |
| 4,8-bis(hydroxy-methyl)tricyclo(5.2.1.0)decane | 13.50 | 13.50 | 13.50 | 13.50 | 13.50 |
| Irgacure 2022 | 0.48 | 0.48 | 0.48 | 0.48 | 0.48 |
| Chivacure 1176 | 1.50 | 1.50 | 1.50 | 1.50 | 1.50 |
| SR 399 | 4.60 | 4.60 | 4.60 | 4.60 | 4.60 |
| RESULTS | | | | | |
| Filler % | 0.00 | 8.00 | 16.00 | 24.00 | 31.97 |
| Rz Performance | 3.33 | 3.53 | 2.95 | 3.47 | 3.88 |
| Stock Removal Performance (g) | 0.96 | 1.01 | 1.14 | 0.90 | 0.89 |

As illustrated in this example, the Rz Performance reaches a minimum of 2.95 and the Stock Removal Performance reaches a maximum of 1.14 with sample 1.3 including 16.00 wt % particulate filler.

Example 2

In another example, the influence of polyol species on Rz Performance, Stock Removal Performance, Glass Transition Temperature (Tg), and Elasticity Modulus is measured. The binder formulations forming the size coats of the sample abrasive articles include one polyol selected from the group consisting of Terathane 250, Terathane 1000, 4,8-bis(hydroxymethyl)tricyclo(5.2.1.0)decane, 2-ethyl-1,3-hexanediol, and 1,5-pentanediol. The selected polyol is mixed with Nanopox XP 22/0314, Irgacure 2022, Chivacure 1176, and Nanocryl XP 21/0940. Nanocryl XP 21/0940 is an acrylate precursor (tetraacrylate) including 50 wt % colloidal silica particulate filler, available from Hanse Chemie, Berlin. The concentrations and results are illustrated in TABLE 2.

TABLE 2

| | 2.1 Wt % | 2.2 Wt % | 2.3 Wt % | 2.4 Wt % | 2.5 Wt % |
|---|---|---|---|---|---|
| INGREDIENT | | | | | |
| Nanopox XP 22/0314 | 74.46 | 74.46 | 74.46 | 74.46 | 74.46 |
| Irgacure 2022 | 0.48 | 0.48 | 0.48 | 0.48 | 0.48 |
| Chivacure 1176 | 1.50 | 1.50 | 1.50 | 1.50 | 1.50 |
| Nanocryl XP 21/0940 | 11.06 | 11.06 | 11.06 | 11.06 | 11.06 |
| Terathane 250 | 12.49 | | | | |
| Terathane 1000 | | 12.49 | | | |
| 4,8-bis(hydroxy-methyl)tri-cyclo(5.2.1.0)decane | | | 12.49 | | |
| 2-ethyl-1,3-hexanediol | | | | 12.49 | |
| 1,5-pentanediol | | | | | 12.49 |
| RESULTS | | | | | |
| Filler % | 35.32 | 35.32 | 35.32 | 35.32 | 35.32 |
| Rz Performance | 2.48 | 3.68 | 3.13 | 2.15 | 1.43 |
| Stock Removal Performance (g) | 0.52 | 0.67 | 1.00 | 0.56 | 0.25 |
| Tg (tan delta) | 84.25 | 116.55 | 139.8 | 93.6 | 53.85 |
| E' at 23 C. (MPa) | 2374.5 | 2591.5 | 3258 | 2819.5 | 1992 |

Sample 2.5 including 1,5-pentanediol provides the lowest Rz Performance of 1.43 but has poor Stock Removal Performance. The best Stock Removal Performance of 1.00 g is found with Sample 2.3 formed of 4,8-bis(hydroxymethyl) tricyclo(5.2.1.0)decane. Sample 2.3 also has the highest elasticity modulus of 3258 MPa and the highest Tg of 139.8 of the samples in this example.

Example 3

In this example, the influence of types of acrylate monomer on Rz Performance and Stock Removal Performance are tested. Three acrylate resins (Nanocryl XP 21/0940 (tetraacrylate), Nanocryl XP 21/0930 (diacrylate), and Nanocryl 21/0954 (trimethylolpropan ethox triacrylate), each including 50 wt % colloidal silica particulate filler and each available from Hanse Chemie) are tested. The size coat binder formulations further include Nanopox XP 22/0314, 1,5-pentanediol, Irgacure 2022, and Chivacure 1176. The compositions and results are illustrated in Table 3.

TABLE 3

| | 3.4 Wt % | 3.5 Wt % | 3.6 Wt % |
|---|---|---|---|
| INGREDIENT | | | |
| Nanopox XP 22/0314 | 77.28 | 77.28 | 77.28 |
| 1,5-pentanediol | 15.46 | 15.46 | 15.46 |
| Irgacure 2022 | 0.52 | 0.52 | 0.52 |
| Chivacure 1176 | 1.50 | 1.50 | 1.50 |
| Nanocryl XP 21/0940 | 5.15 | | |
| Nanocryl XP 21/0930 | | 5.15 | |
| Nanocryl XP 21/0954 | | | 5.15 |
| RESULTS | | | |
| Filler % | 33.49 | 33.49 | 33.49 |
| Rz Performance | 4.02 | 5.70 | 6.60 |
| Stock Removal Performance | 0.45 | 0.46 | 0.37 |

Sample 3.4 including Nanocryl XP/0940 exhibits the lowest Rz Performance while showing comparable Stock Removal Performance to the other samples of this example.

Example 4

In a further example, the influence of epoxy monomers on Rz Performance and Stock Removal Performance is tested. The concentrations of two epoxy components (Nanopox XP 22/0314 and Nanopox 22/0516 (bisphenol A diglycidyl ether), each available from Hanse Chemie) having nano-sized silica particulate filler are varied. In addition, an oxetane component, OXT-212 (3-ethyl-3-(2-ethylhexyloxymethyl) oxetane), is included. A polyol (Terathane 250) and a photocatalyst (Chivacure 1176) are included. The compositions and results are illustrated in Table 4.

TABLE 4

| | 4.1 Wt % | 4.2 Wt % | 4.3 Wt % | 4.4 Wt % |
|---|---|---|---|---|
| INGREDIENT | | | | |
| Nanopox XP 22/0314 | 67.89 | 58.19 | 48.50 | 38.80 |
| Nanopox XP 22/0516 | 9.70 | 19.40 | 29.10 | 38.80 |
| Terathane 250 | 9.70 | 9.70 | 9.70 | 9.70 |
| OXT-212 | 9.70 | 9.70 | 9.70 | 9.70 |
| Chivacure 1176 | 2.91 | 2.91 | 2.91 | 2.91 |
| RESULTS | | | | |
| Filler % | 31.04 | 31.04 | 31.04 | 31.04 |
| Rz Performance | 2.75 | 2.75 | 2.65 | 2.00 |
| Stock Removal Performance (g) | 0.72 | 0.74 | 0.70 | 0.69 |

Sample 4.4 exhibits the lowest Rz Performance of 2.00. Other samples (4.1, 4.2, and 4.3) exhibit comparable Rz Performance 2.65-2.75. Each of the samples exhibits comparable Stock Removal Performance (0.69-0.74 g).

Example 5

In another example, a sample is prepared using a size coat having the binder formulation illustrated in Table 5. The binder formulation includes both nano-sized filler particles supplied through the addition of Nanopox A 610 and micron-sized fillers (NP-30 and ATH S-3) having an approximate average particle size of 3 microns. NP-30 includes spherical silica particles having an average particle size of about 3 micron. ATH S-3 includes non-spherical alumina anhydride particles having an average particle size of about 3 microns. The sample has a Young's modulus of 8.9 GPa (1300 ksi), a tensile strength of 77.2 MPa (11.2 ksi), and an elongation at break of 1%. In addition, an abrasive article having a size coat formed of the formulation exhibits an Rz Performance of 1.75 and a stock removal of 0.0082 mm. The stock removal is indicated by a change of 0.0082 mm in the diameter of the test ring described in the experimental method above.

TABLE 5

| | Wt. % |
|---|---|
| INGREDIENT | |
| UVR-6105 | 0.71 |
| Heloxy 67 | 6.50 |
| SR-351 | 2.91 |
| DPHA | 1.80 |
| (3-glycidoxypropyl)trimethoxysilane | 1.17 |
| Chivacure 184 | 0.78 |
| NP-30 | 46.71 |
| ATH S-3 | 7.78 |
| Nanopox A 610 | 27.75 |
| Chivacure 1176 | 3.89 |
| SDA 5688 | 0.00072 |
| PERFORMANCE | |
| RZ Performance | 1.75 |
| Stock Removal | 0.0082 mm |
| Young's Modulus | 8.9 GPa (1300 ksi) |
| Tensile Strength | 77.2 MPa (11200 psi) |
| Elongation | 1% |

The above-disclosed subject matter is to be considered illustrative, and not restrictive, and the appended claims are intended to cover all such modifications, enhancements, and other embodiments, which fall within the true scope of the present invention.

The invention claimed is:

1. A coated abrasive article comprising:

abrasive grains and a colloidal composite binder composition comprising, based on the weight of the colloidal composite binder composition, about 5 wt % to about 80 wt % of a dispersion of colloidal silica suspended in an external phase of a cationically curable polymer resin, wherein the colloidal silica has an average particle size of 3 nm to 100 nm;

not greater than about 60 wt % of an additional cationically polymerizable compound, wherein the cationically polymerizable compound is the same or different than the cationically curable polymer resin in which the colloidal silica is suspended;

not greater than about 40 wt % of radically polymerizable compound; and about 1.0 wt % to not greater than about 15 wt % of a polyol.

2. The coated abrasive article of claim 1, wherein the colloidal silica has a particle size distribution having a half-width not more than about twice the average particle size of the colloidal silica.

3. The coated abrasive article of claim 1, wherein the colloidal silica comprises a polycondensate silicate.

4. The abrasive article of claim 1, wherein when fully cured has a tensile strength of at least 20 Mpa, a Young's modulus of at least about 500 MPa, and an elongation at break value of at least about 1.0%.

5. The coated abrasive article of claim 4, wherein the colloidal composite binder has an Rz Performance not greater than about 3.0.

6. The abrasive article of claim 1, wherein the amount of polyol is about 8 wt % to 14 wt %.

7. The abrasive article of claim 1, wherein the polyol is selected from the group consisting of a monoalkyl ether of alkyleneglycol, alkylene and arylalkylene; a polytetramethylene glycol; an alicyclic polyol; and combinations thereof.

8. The abrasive article of claim 7, wherein the polyol is selected from the group consisting of 2-ethyl-1,3-hexanediol; 1,5-pentanediol; a polytetramethylene ether glycol having a molecular weight from 200 to 1100; and 4,8-bis(hydroxymethyl)tricyclo(5.2.1.0)decane.

9. The abrasive article of claim 1, wherein the total amount of colloidal silicon dioxide is in a range of 10 wt % to 40 wt % of the colloidal composite binder composition.

10. The abrasive article of claim 1, wherein the colloidal composite binder comprises:

about 20 wt % to about 80 wt % of a dispersion of colloidal silica suspended in an external phase of a cationically curable polymer resin;

about 10 wt % to about 60 wt % of an additional cationically polymerizable compound, wherein the cationically polymerizable compound is the same or different than the cationically curable polymer resin in which the colloidal silica is suspended;

about 1.0 wt % to about 20 wt % radically polymerizable compound; and about 1.0 wt % to about 15 wt % of a polyol.

* * * * *